United States Patent [19]

Utzinger

[11] 4,152,984

[45] May 8, 1979

[54] INKING MECHANISM FOR PRINTING APPARATUS

[75] Inventor: William F. Utzinger, Kettering, Ohio

[73] Assignee: Monarch Marking Systems, Inc., Dayton, Ohio

[21] Appl. No.: 809,485

[22] Filed: Jun. 23, 1977

Related U.S. Application Data

[63] Continuation of Ser. No. 698,990, Jun. 23, 1976, abandoned, which is a continuation of Ser. No. 502,479, Sep. 9, 1974, abandoned.

[51] Int. Cl.[2] ..... B41F 1/42

[52] U.S. Cl. ..... 101/292; 101/103; 101/324

[58] Field of Search ..... 101/69, 78, 81–83, 101/97, 98, 101, 103, 104, 108, 292, 293, 300, 302, 303, 307, 310, 311, 312, 316, 317–319, 324, 325, 333, 334, 335, 338, 339, 359–362; 156/384

[56] References Cited

U.S. PATENT DOCUMENTS

| | | | |
|---|---|---|---|
| 613,161 | 10/1898 | Lee | 101/318 |
| 641,616 | 1/1900 | Thexton | 101/318 |
| 815,124 | 3/1906 | Scotford | 101/83 |
| 1,353,994 | 9/1920 | Folger et al. | 101/103 |
| 2,029,646 | 2/1936 | Welter | 101/324 X |
| 2,039,072 | 4/1936 | Dugdace | 101/318 X |
| 2,263,893 | 11/1941 | Schulman | 101/376 X |
| 2,756,674 | 7/1956 | Rieger et al. | 101/333 X |
| 2,848,944 | 8/1958 | McLaughlin | 101/319 X |
| 3,164,086 | 1/1965 | Keck | 101/97 X |
| 3,408,931 | 11/1968 | Austin | 101/318 |
| 3,601,042 | 8/1971 | Hamisch | 101/69 |

*Primary Examiner*—J. Reed Fisher
*Attorney, Agent, or Firm*—Joseph J. Grass

[57] ABSTRACT

There is disclosed printing apparatus having a print head, a cooperable platen, and an inking mechanism with a traveling inker. The inker includes a low cost ink cartridge and the printing apparatus yieldably mounts the ink cartridge.

The inker alternately contacts the ink cartridge and the print head. The ink cartridge is displaced and can cant when the inker contacts the ink cartridge so that there is uniform pressure contact between the inker and the ink cartridge.

14 Claims, 8 Drawing Figures

INKING MECHANISM FOR PRINTING APPARATUS

CROSS-REFERENCE TO RELATED APPLICATIONS

This is a continuation of Ser. No. 698,990, filed June 23, 1976, now abandoned, which is a continuation of Ser. No. 502,479, filed Sept. 9, 1974, now abandoned.

BACKGROUND OF THE INVENTION

1. Field of the Invention

This invention relates to the printing and inking art.

2. Brief Description of the Prior Art

The U.S. patents to Rieger et al U.S. Pat. No. 2,756,674, Hamisch, Sr. U.S. Pat. No. 3,180,254, and Hamisch, Sr. No. 3,601,042 disclose inking mechanisms having cartridges and traveling inkers of the type to which the invention is directed. U.S. patent to Geiler U.S. Pat. No. 2,696,784 discloses a traveling inker, but does not disclose any ink cartridge. U.S. patents to Lee U.S. Pat. No. 613,161 and Austin U.S. Pat. No. 3,408,931 disclose yieldably mounted ink pads. Canadian patent No. 653,495 to Rieger discloses a print head similar to the one illustrated in the present application.

SUMMARY OF THE INVENTION

The invention is directed to an inking mechanism for a printer in which a traveling inker alternately contacts an ink cartridge and the printing members of a print head. The cartridge is yieldably mounted to the movable one of the print head and a cooperable platen. When the inker contacts the ink cartridge, the mounting means for the ink cartridge yields. More specifically the ink cartridge can cant out of its normal disposition so that the inker contacts the cartridge with more uniform pressure than with the inking mechanisms of the prior art. The ink cartridge is contacted by a spring which is preferably a very light spring so that the cartridge will yield readily. According to the invention, mounting means including supports are formed integrally with the print head in one embodiment and as part of a bracket in another embodiment. In both embodiments, a pair of cutouts are illustrated as being provided for holding the ink cartridge in a home position. The ink cartridge is held captive in the cutouts but a spent cartridge is readily removed and replaceable with a new cartridge. The force of the spring is adjustable by shifting the spring relative to the print head. The novel cartridge is provided with four wall panels and an end wall panel and ink receptive material in the form of a pad is retained by the body of the cartridge. The body is provided with projections which present a line of contact to the supports to define the home position of the ink cartridge. The body has a manually graspable handle by which the ink cartridge can be inserted and removed. The body, the projections and the handle are of one-piece construction and are composed of molded plastics material.

DETAILED DESCRIPTION OF THE PREFERRED EMBODIMENTS

Figure 1:
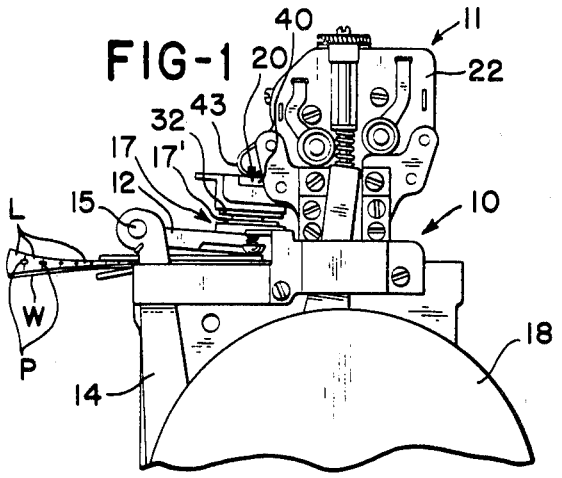
FIG. 1 is a fragmentary side elevational view of printing apparatus employing the inking mechanism of the invention, showing components in their home positions.
Figure 2:
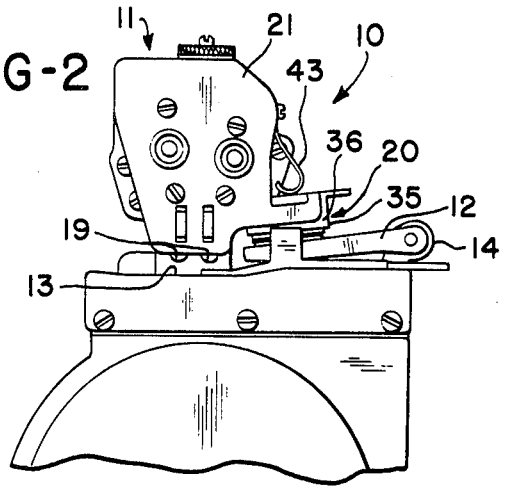
FIG. 2 is a side elevational view of the other side of the apparatus from that shown in FIG. 1.

The apparatus illustrated in the drawings of the embodiments of FIGS. 1 through 6, and 7 and 8, is generally in accordance with the apparatus illustrated in Geiler U.S. Pat. No. 2,696,784, to which further reference can be made for the mechanism for operating print head 11 and feed finger 12.

The feed finger 12 is reciprocated across the web W of labels L which move across the top of the platen 13. The print head 11 cooperates with the platen 13 to print successive labels L. A bell crank actuating lever 14 is pivotally connected to the feed finger 12 by a pin 15. The lever 14 is alternately pivoted clockwise and counterclockwise by a cam (not shown) as in U.S. Pat. No. 2,696,784. The pin 15 also pivotally mounts an inker generally indicated at 17. By operation of a cam (not shown) as in U.S. Pat. No. 2,696,784, the print head 11 is alternately raised and lowered. The print head 11 is shown in FIG. 1 to be in its initial or home position in which the print head 11 is slightly spaced above the platen 13. By operation of a crank wheel 18, the print head 11 is raised and immediately thereafter the lever 14 drives the feed finger 12 and the inker 17 to the right from the position shown in FIG. 1. As the feed finger 12 moves to the right, it engages a perforation P in the label web W and feeds the label web W to the right as viewed in FIG. 1 to position another label L between the print head 11 and the platen 13. While the print head 11 is raised and as the feed finger 12 moves to the right (FIG. 1), the inker 17 also moves to the right between the print head 11 and the platen 13. In this position of the inker 17, a cam-operated pusher (not shown) is raised to urge ink pad 17' of the inker 17 into inking contact with the print head 11. Immediately thereafter the pusher (not shown) is lowered out of contact with the print head 11 and thereupon the lever 14 is pivoted counterclockwise, pulling the feed finger 12 and the inker 17 to the left to the home position shown in FIG. 1. After the inker 17 and the feed finger 12 have cleared the print head 11, the print head 11 is driven toward the label web W. While the print head 11 is moving toward the platen 13, a cartridge 20 moves into contact with the pad 17' of the inker 17. Continued travel of the print head 11 toward the platen after contact of the cartridge 20 with the pad 17' causes projections 39 and 40 to start moving away from surfaces 23' and 24' against the action of a spring 43. Printing of the label L takes place at the end of travel of the print head 11 toward the platen 13. In the remainder of the machine cycle, the print head 11 moves away from the platen 13 toward its initial position. During the return of the print head 11 to its initial position, the spring 43 returns the cartridge 20 to the position in which the projections 39 and 40 are in contact with surfaces 23' and 24' of the respective supports 23 and 24. In the apparatus according to U.S. Pat. No. 2,696,784, the inker was inked by the user who applied ink from a bottle to the ink pad of the inker. In accordance with the present invention, the ink cartridge generally indicated at 20 is both resiliently and readily removably mounted to the print head 11.

The print head 11 is comprised of a pair of frame members 21 and 22 which mount printing members 19 in the form of endless printing bands. A detailed disclosure of the print head 11 is shown in Canadian patent No. 653,495. According to the embodiment of FIGS. 1 through 6 the supports 23 and 24 are formed integrally with the frame members 21 and 22. The supports 23 and 24 define cutouts 25 and 25. The cutouts 25 and 26 are open on one side to serve as access openings. More specifically, the supports 23 and 24 comprise arms 27 and 28 with upturned portions or extensions 29 and 30.

The ink cartridge 20 includes a rigid ink cartridge body 31 and ink-receptive material 32 in the form of a pad received and suitably retained in a recess in the body 31. The ink cartridge body 31 has four wall panels 33, 34, 35 and 36 joined to each other. An end panel 37 is joined to the one ends of the wall panels 33 through 36. A handle 38 which is in the same plane as the end panel 37 is joined to the one end of the wall panel 33. The pair of projections 39 and 40 are joined to the one ends of the wall panels 36 and 34, respectively. The ink-receptive material 32 projects beyond the other ends of the wall panels 33 through 36. The projections 39 and 40 are of identical construction. Each of the projections 39 and 40 has a flat surface 41 and 42. The flat surfaces 41 and 42 provide line contact with the flat surfaces 23' and 24' of the supports 23 and 24. If desired a home position for the ink cartridge can be provided by other means such as by two spaced apart projections on both sides of the inker body 31, or by two spaced apart projections on one side of the body and a round projection on the other side of the body, or by a flat projection on one side of the body and a round projection on the other side of the body, or any equivalent means. The ends of the flats 41 and 42 are joined with respective radiused portions 41' and 42'. The projections 39 and 40 of the cartridge 20 are normally held in contact with the flats 23' and 24' of the supports 23 and 24 by a one-piece leaf spring 43 which continuously bears against the end panel 37. The supports 23 and 24 and the spring 43 are considered to be the mounting structure for the cartridge 20. The leaf spring 43 is preferably a very light spring so that the force exerted on the end panel is minimal, that is, just enough to cause the proper amount of ink to be transferred from the ink receptive material 32 to ink receptive pad 17' of the inker 17. The spring 43 has a curved portion 44 which merges with a straight portion 45. The straight portion 45 is merged with a straight portion 46 by a curved portion 47. The curved portion 47 is curved in the opposite direction from the curved portion 44. The straight portion 46 has a pair of enlarged slots or cutouts 48. Screws 49 pass through the respective slots 38 and are threadably received in a transverse support bar 50' which joins the frame members 21 and 22. Accordingly, by loosening screws 49, the force which the spring exerts on the ink cartridge 20 can be adjusted and thereafter the screws 49 can be tightened to hold the spring 43 in its adjusted position.

Figure 3:
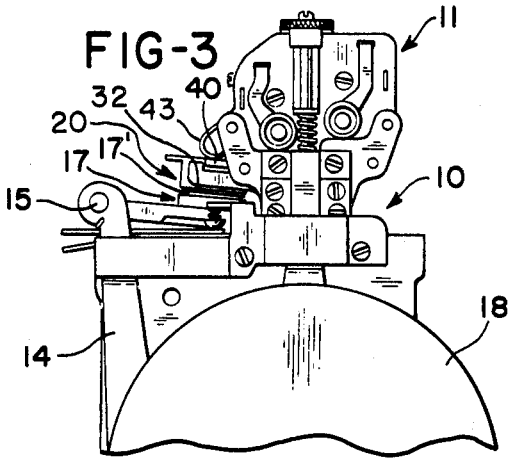
FIG. 3 is a view similar to FIG. 1, but showing the ink pad of the inker in ink-receiving contact with the ink cartridge.
Figure 4:
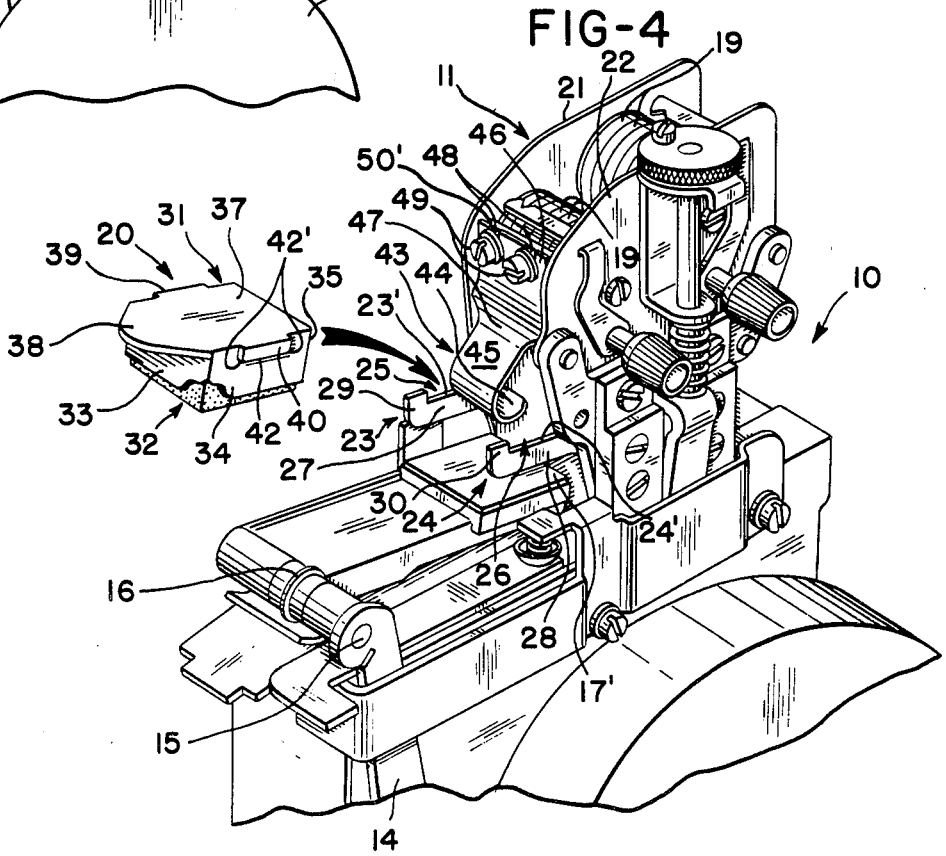
FIG. 4 is a perspective view of the apparatus showing the ink cartridge exploded away.

As shown in FIG. 3, when the print head 11 is in printing relationship with respect to a label L of the label web W, the ink pad 17' of the inker 17 is in contact with the ink-receptive material 32 of the cartridge 20 and the projections 39 and 40 are caused to move away from the respective flats 23' and 24' against the action of the spring 43. As soon as the print head 11 begins to move away from the platen 13, the spring 43 serves to return the cartridge 20 to its initial position in which the projections 39 and 40 are supported by the supports 23 and 24.

Figure 5:
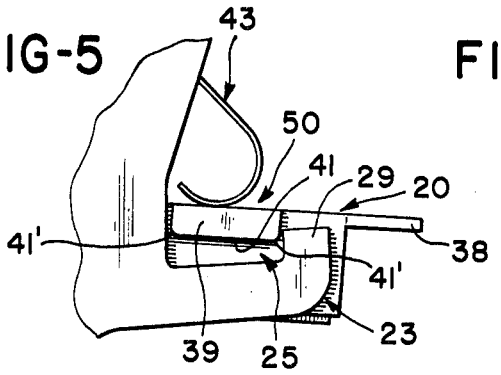
FIG. 5 is a fragmentary side elevational view showing the ink cartridge canted in one direction.
Figure 6:
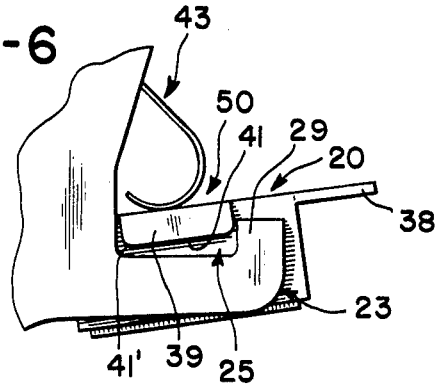
FIG. 6 is a view similar to FIG. 5, but showing the ink cartridge canted in another direction.

With reference to FIGS. 5 and 6, it is seen that the projection 39 is shorter than the respective cutout 25 so as not to bind, and the same is true for the projection 40 and the respective cutout 26. FIG. 5 shows exaggeratedly that the cartridge 20 can be canted away from its normal position to accommodate an inker pad having an irregular contour or an ink pad which is presented to the cartridge 20 at an inclined angle. While FIG. 5 shows the ink cartridge canted in one direction, FIG. 6 shows the ink cartridge canted in another direction. It is also feasible with the illustrated construction that the cartridge 20 can be canted in other planes, as for example, when the projection 29 is lifted away from the support 23 either further than or less than the projection 40 is lifted away from the support 24. Accordingly, the cartridge 20 can be canted in any plane depending upon the inclination of the ink-receiving surface of the inker 17 which is presented against the ink-receptive material 32 of the cartridge 20.

The cartridge 20 can be easily inserted into the apparatus 10 through a throat 50 between the upturned positions 29 and 30 and the spring 43 by manually flexing the spring 43 to the left as shown in FIGS. 5 and 6 and then simply moving the cartridge 20 to a position in which the lugs 39 and 40 are in respective cutouts 25 and 26. The cartridge 20 can be removed by manually flexing the spring 43 to the left as shown in FIGS. 5 and 6 and pulling the cartridge 20 out by its handle 38.

Figure 7:
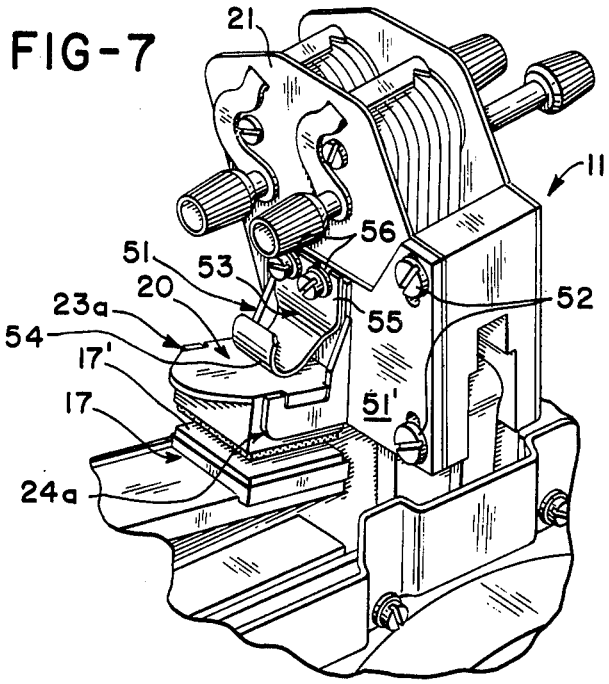
FIG. 7 is a perspective view of an alternative embodiment of the invention.
Figure 8:
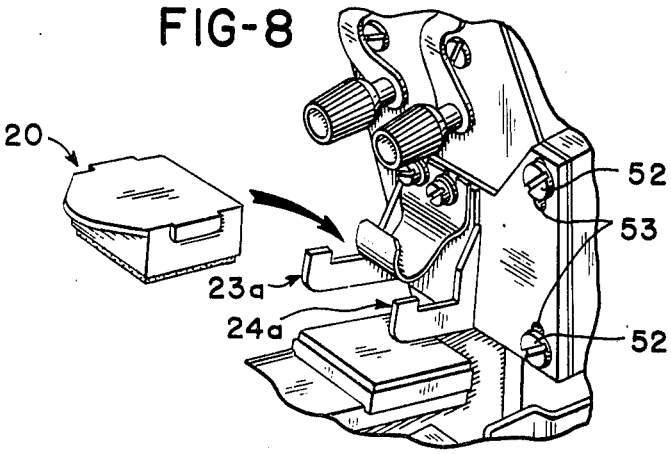
FIG. 8 is a fragmentary perpective view of the embodiment illustrated in FIG. 7, but showing the ink cartridge exploded away.

In the embodiment of FIGS. 7 and 8, the print head 11 is disposed at right angles from the position of the embodiment of FIGS. 1 through 6. The cartridge 20 is shown to be mounted by a bracket 51 to one of the frame members 21 by screws 52. The screws 52 extend through enlarged holes 53 in the bracket 51 so that the bracket 51 is adjustable relative to the print head 11. Supports **23*a* and 24*a* are identical to the supports 23 and 24 except that they are secured to a bracket panel 51' of the bracket 51 instead of being formed integrally with the frame members as in the embodiment of FIGS. 1 through 6. A leaf spring 53 resiliently mounts the cartridge 20. The spring 53 is preferably of one-piece construction and includes a curved portion or extension 54 joined with a generally straight portion 55. The portion 55 has a pair of enlarged elongated slots or cutouts 56 like the cutouts 48 which enable the force exerted by the spring 53 on the cartridge 20** to be adjusted.

Although the ink cartridge 20 is illustrated to be mounted on the movable print head 11, it is obvious that through a reversal of parts, the platen can be movably mounted on the print head can be fixedly mounted, in which event the ink cartridge can be mounted on the movable platen.

Other embodiments and modifications of this invention will suggest themselves to those skilled in the art, and all such of these as come within the spirit of this invention are included within its scope as best defined by the appended claims.

I claim:

1. Printing apparatus, comprising: an ink cartridge, a print head and a cooperable platen, one of the print head and the platen being movable and the other being fixed, a traveling inker having an ink pad, means including open-sided cutouts for mounting the ink cartridge to the movable one of the print head and the platen for canting movement upon contact with the ink pad, the mounting means providing an entrance throat opening into the cutouts for inserting and removing the ink cartridge, the throat comprising a leaf spring having a curved portion, the leaf spring being deflectable to open the throat while the cartridge is being inserted or removed, the curved portion contacting the ink cartridge to allow the ink cartridge to cant in any plane during cooperation with the ink pad.

2. Printing apparatus, comprising: an ink cartridge, a print head and a cooperable platen, one of the print head and the platen being movable and the other being fixed, a traveling inker having an ink pad, means including open-sided cutouts for mounting the ink cartridge to the movable one of the print head and the platen for canting movement upon contact with the ink pad, the mounting means providing an entrance throat opening into the cutouts for inserting and removing the ink cartridge, the throat comprising a spring having a curved portion, the spring being deflectable to open the throat while the cartridge is being inserted or removed, the curved portion contacting the ink cartridge to allow the ink cartridge to cant in any plane during cooperation with the ink pad.

3. Printing apparatus, comprising: printing means including a print head and a platen, one of the print head and the platen being movably mounted and the other being fixed, an ink cartridge comprising an ink cartridge body and ink receptive pad held by the cartridge, a traveling inker cooperating alternately with the ink cartridge and the print head, and means for yieldably mounting the ink cartridge body relative to the inker for canting movement in any plane so that when the inker contacts the ink receptive pad the cartridge accommodates for differences between the angular disposition of the inker and the angular disposition of the ink cartridge, wherein the mounting means comprises a pair of cutouts and a spring, the ink cartridge body having a pair of projections, each cutout having an access opening so that the projections can be inserted into and removed from the cutouts for ready replacement of a spent ink cartridge with a new ink cartridge, the cutouts being contoured to hold the cartridge body captive but enabling the ink cartridge body to yield against the action of the spring.

4. Printing apparatus, comprising: printing means including a print head and a platen, one of the print head and the platen being movable and the other being fixed, an ink cartridge, a traveling inker cooperating alternately with the ink cartridge and the print head, means mounting the ink cartridge to the movable one of the print head and the platen for canting movement in any plane upon contact with the ink pad, the cartridge having a pair of projections, the mounting means comprising a pair of spaced-apart supports for supporting the projections, spring means acting on the cartridge for urging the projections into contact with the supports but being yieldable to enable the ink cartridge to move relative to the supports when the inker is moved into contact with the ink cartridge, wherein the print head is movably mounted and comprises a pair of frame members, wherein each support is provided by a cutout in the respective frame member, each cutout having a flat, each projection having a flat for contacting the flat of the respective cutout so that the spring means normally holds the ink cartridge in a home position determined by the respective flats.

5. Printing apparatus, comprising: printing means including a print head and a platen, one of the print head and the platen being movable and the other being fixed, an ink cartridge, a traveling inker cooperating alternately with the ink cartridge and the print head, means mounting the ink cartridge to the movable one of the print head and the platen for canting movement in any plane upon contact with the ink pad, the cartridge having a pair of projections, the mounting means comprising a pair of spaced-apart supports for supporting the projections, spring means acting on the cartridge for urging the projections into contact with the supports but being yieldable to enable the ink cartridge to move relative to the supports when the inker is moved into contact with the ink cartridge, wherein the print head is movably mounted, the mounting means comprises a bracket secured to the print head, each support having means providing a cutout having a flat, each projection having a flat for contacting the flat of the respective cutout so that the spring means normally holds the ink cartridge in a home position determined by the flats.

6. Printing apparatus, comprising: an ink cartridge, a print head and a cooperable platen, one of the print head and the platen being movable and the other being fixed, a traveling inker having an ink pad, means including cutouts for mounting the ink cartridge to the movable one of the print head and the platen for canting movement upon contact with the ink pad, the mounting means providing an expandable throat opening into the cutouts for inserting and removing the ink cartridge, the throat including a leaf spring, the leaf spring being deflectable to expand the throat while the cartridge is being inserted or removed, the leaf spring contacting the ink cartridge to allow the ink cartridge to cant in any plane during cooperation with the ink pad.

7. Printing apparatus, comprising: an ink cartridge, a print head and a cooperable platen, one of the print head and the platen being movable and the other being fixed, a traveling inker having an ink pad, means for mounting the ink cartridge to the movable one of the print head and the platen for canting movement upon contact with the ink pad, the mounting means including a spring providing an expandable throat for inserting and removing the ink cartridge, the spring being deflectable to open the throat while the cartridge is being inserted or removed.

8. Printing apparatus, comprising: printing means including a print head and a platen, one of the print head and the platen being movably mounted and the other being fixed, an ink cartridge comprising an ink cartridge body and ink receptive pad held by the cartridge, a traveling inker cooperating alternately with the ink cartridge and the print head, and means for yieldably mounting the ink cartridge body relative to the inker for canting movement in any plane so that when the inker contacts the ink receptive pad the cartridge accommodates for differences between the angular disposition of the inker and the angular disposition of the ink cartridge, wherein the mounting means comprises a pair of cutouts and a spring, the ink cartridge body having projections, means providing an access opening so that the spring can be flexed and the projections can be inserted into and removed from the cutouts for ready replacement of a spent ink cartridge with a new ink cartridge.

9. Printing apparatus, comprising: printing means including a print head and a platen, the print head including spaced apart supports, one of the print head and the platen being movable and the other being fixed, a replaceable ink cartridge, a traveling inker cooperating alternately with the ink cartridge and the print head, the supports having means defining a home position for the ink cartridge but mounting the ink cartridge for canting movement in any plane upon contact with the ink pad, the supports having further means providing for the ready replacement of a spent ink cartridge with a new ink cartridge, and spring means exerting a force on the ink cartridge for urging the ink cartridge to the home position and enabling the ink cartridge to move relative to the supports when the inker is moved into contact with the ink cartridge.

10. Printing apparatus, comprising: printing means including a print head and a platen, one of the print head and the platen being movable and the other being fixed, a replaceable ink cartridge, a traveling inker cooperating alternately with the ink cartridge and the print head, a bracket secured to the print head, the bracket having spaced apart supports, the supports having means defining a home position for the ink cartridge but mounting the ink cartridge for canting movement in any plane upon contact with the ink pad, the supports having further means providing for the ready replacement of a spent ink cartridge with a new ink cartridge, and spring means exerting a force on the ink cartridge for urging the ink cartridge to the home position and enabling the ink cartridge to move relative to the supports when the inker is moved into contact with the ink cartridge.

11. Printing apparatus, comprising: printing means including a print head and a platen, one of the print head and the platen being movably mounted and the other being fixed, an ink cartridge comprising an ink cartridge body having first, second, third and fourth joined side wall panels and an end wall panel joined to ends of the side wall panels to provide a recess, an ink receptive pad disposed in the recess, a projection extending outwardly from each of the first and third side wall panels, a traveling inker cooperating alternately with the ink cartridge and the print head, and means cooperable with the projections for yieldably mounting the ink cartridge body relative to the inker for canting movement in any plane so that when the inker pad contacts the cartridge pad the cartridge accommodates for differences between the angular disposition of the inker and the angular disposition of the ink cartridge.

12. Printing apparatus, comprising: printing means including a print head and a platen, one of the print head and the platen being movable and the other being fixed, a replaceable ink cartridge, a traveling inker cooperating alternately with the ink cartridge and the print head, spaced apart supports carried by the movable one of the platen and the print head, the supports having means defining a home position for the ink cartridge but mounting the ink cartridge for canting movement in any plane upon contact with the ink pad, the supports having further means providing a yieldable entrance throat for the ready replacement of a spent ink cartridge with a new ink cartridge, and spring means defining part of the throat and connected to the movable one of the print head and the platen exerting a force on the ink cartridge for urging the ink cartridge to the home position and enabling the ink cartridge to move relative to the spaced apart supports when the inker is moved into contact with the ink cartridge.

13. Printing apparatus, comprising: printing means including a print head and a platen, one of the print head and the platen being movably mounted and the other being fixed, an ink cartridge comprising an ink cartridge body, an ink receptive pad carried by the cartridge body, projections connected to the cartridge body, a traveling inker cooperating alternately with the ink receptive pad of the ink cartridge and the print head, and means including a spring connected to the movable one of the print head and platen and cooperable with the projections for removably and yieldably mounting the ink cartridge body relative to the inker for canting movement in any plane so that when the inker pad contacts the cartridge pad the cartridge accommodates for differences between the angular disposition of the inker and the angular disposition of the ink cartridge.

14. Printing apparatus, comprising: a replaceable ink cartridge, a print head and a cooperable platen, one of the print head and the platen being movable and the other being fixed, a traveling inker having an ink pad, means for both supporting the replaceable ink cartridge on the movable one of the print head and platen for canting movement in any plane and for supporting the ink cartridge for ready removal and replacement with a new ink cartridge, the supporting means including a spring for biasing the ink cartridge, and the spring being yieldable when the ink pad cooperates with the ink cartridge.

* * * * *